US012037863B2

(12) United States Patent
Spitz et al.

(10) Patent No.: US 12,037,863 B2
(45) Date of Patent: Jul. 16, 2024

(54) WELLHEAD SYSTEM

(71) Applicant: AKER SOLUTIONS AS, Lysaker (NO)

(72) Inventors: Stuart Spitz, Granada (ES); Robert Johansson, Oslo (NO)

(73) Assignee: AKER SOLUTIONS AS, Lysaker (NO)

( * ) Notice: Subject to any disclaimer, the term of this patent is extended or adjusted under 35 U.S.C. 154(b) by 0 days.

(21) Appl. No.: 18/035,753

(22) PCT Filed: Nov. 8, 2021

(86) PCT No.: PCT/NO2021/050231

§ 371 (c)(1),
(2) Date: May 8, 2023

(87) PCT Pub. No.: WO2022/103272

PCT Pub. Date: May 19, 2022

(65) Prior Publication Data

US 2024/0003212 A1 Jan. 4, 2024

(30) Foreign Application Priority Data

Nov. 10, 2020 (GB) ..... 2017732

(51) Int. Cl.
*E21B 33/035* (2006.01)
*E21B 33/04* (2006.01)
*E21B 41/00* (2006.01)

(52) U.S. Cl.
CPC ..... *E21B 33/035* (2013.01); *E21B 33/0415* (2013.01); *E21B 41/0014* (2013.01)

(58) Field of Classification Search
CPC . E21B 33/035; E21B 33/0415; E21B 41/0014
See application file for complete search history.

(56) References Cited

U.S. PATENT DOCUMENTS 8,511,389 B2 * 8/2013 Fenton ..... E21B 33/0385 166/341
11,421,501 B2 * 8/2022 Murphy ..... E21B 33/035
(Continued)

FOREIGN PATENT DOCUMENTS

WO WO 2020/146187 A1 7/2020

*Primary Examiner* — Matthew R Buck
(74) *Attorney, Agent, or Firm* — Norman B. Thot

(57) ABSTRACT

A wellhead system includes a wellhead assembly which is generally tubular, a landing string assembly, and an orientation sensor assembly which is mounted on the landing string assembly. The wellhead assembly is secured to a top of a borehole and has an orientation engagement part. The landing string assembly is lowered into the wellhead assembly to land in the wellhead assembly. The landing string assembly has an orientation part with an orientation feature. The orientation engagement part of the wellhead assembly corresponds to the orientation feature. As the landing string assembly is lowered into the wellhead assembly, the orientation feature engages with the orientation engagement part to rotate the landing string assembly about its longitudinal axis into a desired orientation relative to the wellhead assembly. The orientation sensor assembly measures an angular rotation of the landing string assembly about its longitudinal axis.

20 Claims, 2 Drawing Sheets

(56) References Cited

U.S. PATENT DOCUMENTS

| | | | | |
|---|---|---|---|---|
| 11,834,918 | B2 * | 12/2023 | McLaughlin | E21B 33/043 |
| 2008/0017368 | A1 | 1/2008 | Hopper et al. | |
| 2014/0054044 | A1 * | 2/2014 | Nellessen, Jr. | E21B 23/01 166/341 |
| 2015/0259990 | A1 * | 9/2015 | June | E21B 33/038 166/341 |
| 2018/0320469 | A1 * | 11/2018 | June | E21B 23/02 |
| 2020/0217165 | A1 * | 7/2020 | Robottom | E21B 33/04 |

* cited by examiner

WELLHEAD SYSTEM

CROSS REFERENCE TO PRIOR APPLICATIONS

This application is a U.S. National Phase application under 35 U.S.C. § 371 of International Application No. PCT/NO2021/050231, filed on Nov. 8, 2021 and which claims benefit to Great British Patent Application No. GB 2017732.5, filed on Nov. 10, 2020. The International Application was published in English on May 19, 2022 as WO 2022/103272 A1 under PCT Article 21(2).

FIELD

The present invention relates to a wellhead system and in particular to a wellhead system which includes an orientation system for verifying the orientation of a tubing hanger relative to a wellhead.

BACKGROUND

A wellhead system typically comprises a wellhead housing mounted at the upper end of a wellbore, and a tubing hanger which is secured to the wellhead housing. The tubing hanger supports a long tubing string, known as production tubing, which extends down into the wellbore, and which provides a conduit for the flow of formation fluid out of the wellbore. The tubing hanger may be supported by a tubing spool which is mounted on top of the wellhead, or directly in the wellhead housing.

For a subsea wellhead, during the completion of the wellhead system, a blowout preventer (BOP) stack is mounted on the wellhead housing or, where a tubing spool is used, on the tubing spool, and a riser extends upwards from the BOP stack to a surface rig or vessel. The tubing hanger and associated production tubing is installed by securing a tubing hanger running tool to the tubing hanger, and by using a landing string to lower the tubing hanger running tool etc. down the riser towards the wellhead, so as to land the tubing hanger in the desired position in the tubing spool/wellhead housing. The tubing hanger running tool can then be disconnected from the tubing hanger, and the landing string and tubing hanger running tool lifted out of the riser. The well is then prepared for completion by temporarily plugging the tubing hanger/production tubing, and removing the riser and BOP. A Christmas tree is them mounted on top of the tubing spool/wellhead housing, and the Christmas tree connected, via a tie-in arrangement, to production flow lines which carry the formation fluids flowing out of the wellbore.

In order to provide that the tie-in connections between the Christmas tree and the production flowlines are properly connected, and do not leak to any significant degree, it is important to land the Christmas tree so that it is oriented in a predetermined orientation relative to the wellhead housing. A proper sealing of the tie-in connectors may be impossible if the Christmas tree is rotated about the longitudinal axis of the wellhead housing by even 1 or 2 degrees from the desired orientation.

Tubing hangers often provide conduits for communication between the topside and the space in the wellhead below the tubing hanger, for example, for communication with or operation of sensors or equipment in the wellbore. These could be conduits for fluid flow or comprise connections for the transmission of electrical or optical signals. Stab connectors or the like are typically provided at the upper end of the tubing hanger to provide the means for connection to these conduits/connections, and these mate with corresponding connectors provided on the Christmas tree when the Christmas tree is landed on the wellhead. Because of these connections between the Christmas tree and the tubing hanger, the orientation of the Christmas tree is set by the orientation of the tubing hanger relative to the wellhead housing. It is therefore critical that the tubing hanger is correctly oriented relative to the wellhead when the tubing hanger is landed in the tubing spool in order to provide that the orientation of the Christmas tree is correct when it is eventually landed.

Any misalignment of the tubing hanger may not become apparent until after the well is completed, and the riser and BOP removed, and the Christmas tree landed, connected to the tie-in and tested. To the remedy the situation requires the removal of the Christmas tree, the reinstallation of the BOP and riser, and pulling and reinstalling the tubing hanger, a process which is enormously time consuming and expensive.

Where a tubing spool is provided, the tubing spool typically has a key formation which engages with a corresponding key formation provided on the tubing hanger when the tubing hanger is in the desired orientation. The tubing hanger cannot be landed in the tubing spool unless the two key formations are engaged; the key formation thus provides that the orientation of the tubing hanger, and hence the Christmas tree, is correct.

It will be appreciated that where the wellhead is located in deep water, the landing string can be very long, and significant twisting of the landing string can occur as the tubing hanger running tool is lowered down the riser. Knowledge of the orientation of the tubing hanger running tool relative to the landing string when it was first lowered into the riser therefore does not assist in providing sufficiently accurate information of the orientation of the tubing hanger running tool once it has been lowered down the riser and is approaching the tubing spool.

If significant misalignment of the tubing hanger exists, it may be difficult or impossible to engage the key formations in order to land the tubing hanger.

It is therefore known to provide a mechanical orientation system in which a formation such as a pin or key, which is mounted on a part secured relative to the wellhead housing, interacts with an helical groove or ridge arranged around a part secured relative to the tubing hanger, in order to rotate the tubing hanger into the required orientation to achieve engagement of the key formations and to land the tubing hanger in the tubing spool.

There are typically no such key formations where a tubing spool is not used, and a mechanical orientation system is instead relied on to land the tubing hanger in the wellhead housing at the correct orientation relative to the wellhead housing.

Examples of such mechanical orientation systems are described in US 2015/0259990 and WO 2020/146187.

US 2015/0259990 describes a system where the tubing hanger lands directly in the wellhead housing, and an orientation spool is mounted on top of the wellhead housing. The radially outwardly facing surface of the tubing hanger running tool is provided with a helical groove which, as the THRT engages enters the orientation spool, engages with a pin which is mounted in the orientation spool and which is movable to extend into the passage enclosed by the orientation spool. As the tubing hanger running tool is lowered down the orientation spool, the camming action of the pin in the helical groove rotates the tubing hanger running tool so that the tubing hanger is in the desired orientation as it lands in the wellhead housing.

WO2020/146187 describes a broadly similar system except that rotation to the desired orientation is achieved through the engagement of a pin with a helical ridge provided on a dedicated hanger orientation device which is mounted between the landing string and the THRT.

SUMMARY

An aspect of the present invention is to provide an improved wellhead system which may assist in an early detection of a misalignment of the tubing hanger relative to a wellhead.

In an embodiment, the present invention provides a wellhead system which includes a wellhead assembly which is generally tubular, a landing string assembly, and an orientation sensor assembly which is mounted on the landing string assembly. The wellhead assembly is configured to be secured to a top of a borehole. The wellhead assembly comprises an orientation engagement part. The landing string assembly is configured to be lowered into the wellhead assembly so as to land in the wellhead assembly. The landing string assembly comprises a longitudinal axis, and an orientation part which comprises an orientation feature. The orientation engagement part of the wellhead assembly corresponds to the orientation feature. The orientation engagement part of the wellhead assembly is configured so that, as the landing string assembly is lowered into the wellhead assembly, the orientation feature engages with the orientation engagement part to rotate the landing string assembly about its longitudinal axis into a desired orientation relative to the wellhead assembly. The orientation sensor assembly is configured to measure an angular rotation of the landing string assembly about its longitudinal axis.

BRIEF DESCRIPTION OF THE DRAWINGS

The present invention is described in greater detail below on the basis of embodiments and of the drawings in which.

DETAILED DESCRIPTION

Figure 1:
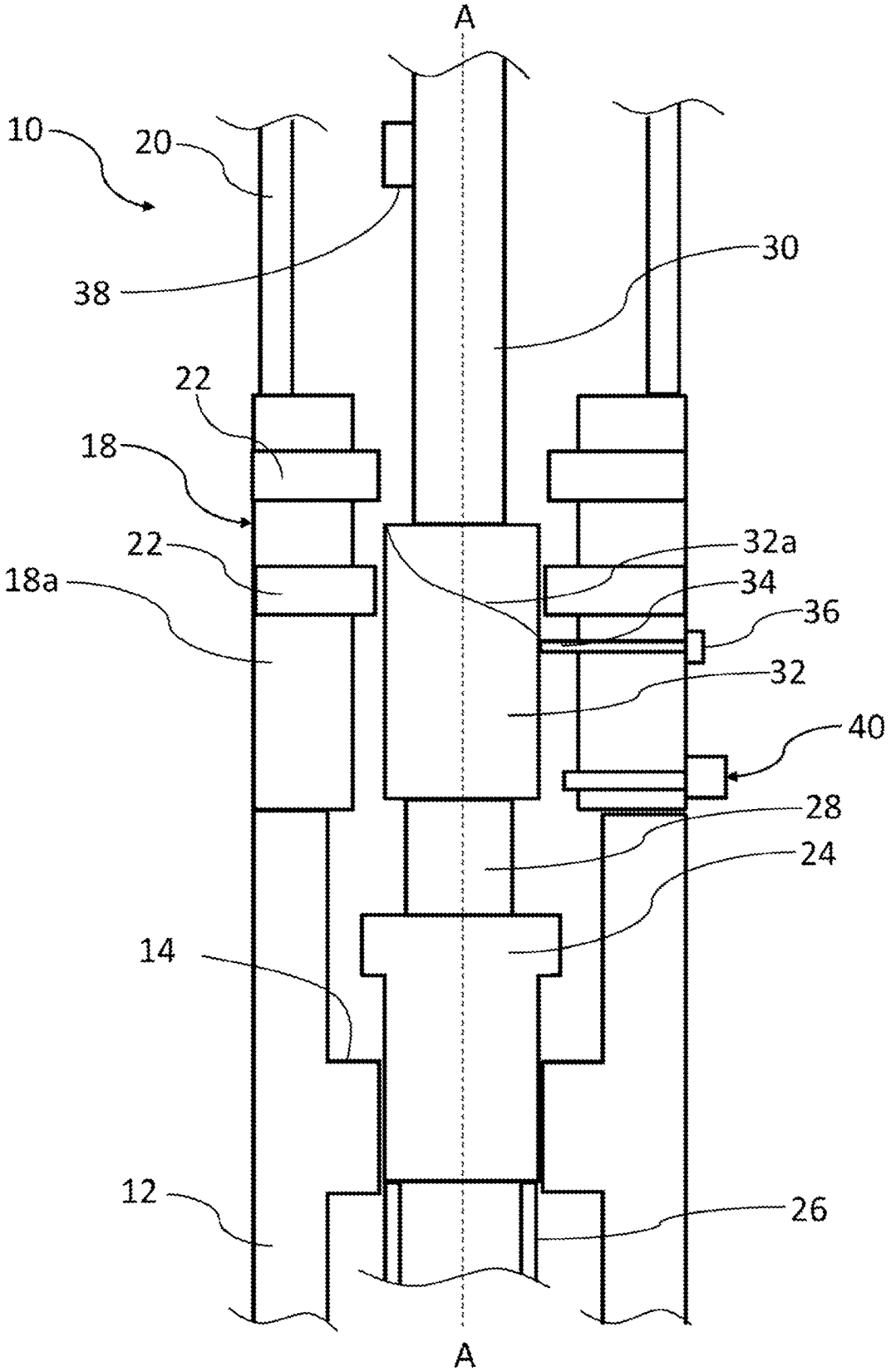
FIG. 1 shows a schematic illustration of a longitudinal cross-section through a wellhead system according to the present invention, with the landing of a tubing hanger in progress.

An aspect of the present invention provides a wellhead system comprising a generally tubular wellhead assembly which is secured to the top of a borehole, and a landing string assembly which is configured to be lowered into the wellhead assembly to land in the wellhead assembly, the landing string assembly having a longitudinal axis and comprising an orientation part which has an orientation feature, and the wellhead assembly being provided with a corresponding orientation engagement part which is configured such that as the landing string assembly is lowered into the wellhead assembly, the orientation feature engages with the orientation engagement part to rotate the landing string assembly about its longitudinal axis into a desired orientation relative to the wellhead assembly, wherein the wellhead system further comprises an orientation sensor assembly which is mounted on the landing string assembly and which is configured to measure the angular rotation of the landing string assembly about its longitudinal axis.

The orientation sensor assembly may comprise at least one gyro sensor.

The wellhead system may further comprise a processor which is connected to the orientation sensor assembly to receive signals from the orientation sensor assembly which is indicative of the angular rotation of the landing string assembly.

The wellhead assembly may include a landing formation on which the landing string assembly may be landed. The processor may in this case be configured to use the signals from the orientation sensor assembly to determine the orientation of the landing string assembly relative to the wellhead assembly when the landing string assembly is landed on the landing formation. The processor may also be configured to issue an alert if the orientation of the landing string assembly relative to the wellhead assembly when the landing string assembly is landed on the landing assembly deviates from a predetermined orientation by more than a predetermined amount.

The landing string assembly may comprise a landing string and a tubing hanger mounted on an end of the landing string. The orientation sensor may in this case be mounted on the landing string adjacent to the end of the landing string.

Where the wellhead assembly is provided with a landing formation, the tubing hanger may be configured to engage with the landing formation when the landing string assembly is landed in the wellhead assembly.

The landing string assembly may further comprise a tubing hanger running tool via which the tubing hanger is mounted on the end of the landing string. The orientation sensor may in this case be mounted on the landing string adjacent to the tubing hanger running tool.

The orientation part may comprise an orientation joint which is mounted between the end of the landing string and the tubing hanger running tool.

The orientation sensor assembly may be a first sensor assembly, and the wellhead system may be provided with a second sensor assembly which is configured to measure either the acceleration or elevation of the landing string assembly.

The second sensor assembly may comprise a proximity sensor such as a Hall effect sensor.

Where the second sensor assembly comprises a proximity sensor, the second sensor assembly may be mounted on the lower end of the landing string assembly or on the wellhead assembly.

In the case where the second sensor assembly is mounted on the landing string assembly, the second sensor assembly may be configured to measure its proximity to an interior surface of the wellhead assembly. The interior surface of the wellhead assembly may in this case be provided with a ridge or groove of sufficient depth to be detected by the proximity sensor as a change in its proximity to the wellhead assembly.

In the case where the second sensor assembly is mounted on the wellhead assembly, the second sensor assembly may be configured to measure its proximity to an exterior surface of the landing string assembly. The exterior surface of the landing string assembly may in this case be provided with a ridge or groove of sufficient depth to be detected by the proximity sensor as a change in its proximity to the wellhead assembly.

Where the second sensor assembly comprises an accelerometer, the second sensor assembly may be mounted on the lower end of the landing string assembly.

Where the second sensor assembly is configured to measure the elevation of the landing string assembly relative to the wellhead assembly, the wellhead system may further comprise a third sensor assembly which is mounted on the lower end of the landing string assembly and which comprises an accelerometer.

The second sensor assembly and, where provided, the third sensor assembly, may be connected to a processor so that the processor receives signals from the sensor assembly/assemblies indicative of the elevation and/or acceleration of the landing string, the processor being programmed to use these signals to provide confirmation to an operator that the landing string has landed on the landing formation.

These and other characteristics will become clear from the following description of illustrative embodiments, which are provided as non-restrictive examples, with reference to the attached drawings.

The following description may use terms such as "horizontal", "vertical", "lateral", "back and forth", "up and down", "upper", "lower", "inner", "outer", "forward", "rear", etc. These terms generally refer to the views and orientations as shown in the drawings which are associated with a normal use of the present invention. The terms are used for the reader's convenience only and shall not be limiting.

The drawings show a subsea wellhead system 10 comprising a tubular wellhead assembly mounted at the upper end of a wellbore (not shown). The wellhead assembly comprises a wellhead housing 12 which is secured to the upper end of the wellbore, and a blowout preventer (BOP) stack 18 mounted on top of the wellhead housing 12. A riser 20 extends upwardly from the top of the BOP stack 18 to a surface installation such as a rig or vessel (not shown).

The BOP stack 18 is of a conventional construction and has a generally cylindrical BOP housing 18*a* which encloses a main passage, and a series of BOP rams 22 (two in this example) which are operable to close and seal around a tubing string extending down the riser 20 into the wellbore, or, if necessary to sever such a tubing string to completely seal the wellbore. The wellhead assembly is arranged so that the longitudinal axes of the various parts of the wellhead assembly all lie along longitudinal axis A and coincide with the well axis.

The wellhead system further comprises a landing string assembly which is configured to be lowered into the wellhead assembly to land in the wellhead assembly.

In this example, the landing string assembly comprises a tubing hanger 24 from which production tubing 26 is suspended, and the wellhead housing is provided with a landing formation, in this example a landing shoulder 14 for supporting the tubing hanger 24. The tubing hanger 24 is installed by securing a tubing hanger running tool 28 to the tubing hanger 24, and using a landing string 30 to lower the tubing hanger running tool 28, tubing hanger 24, and production tubing 26, down the riser 20 and into the wellhead housing 12, until the tubing hanger 24 lands on the landing shoulder 14. The landing string 30, tubing hanger running tool 28, tubing hanger 24, and production tubing 26 together form the landing string assembly.

Figure 2:
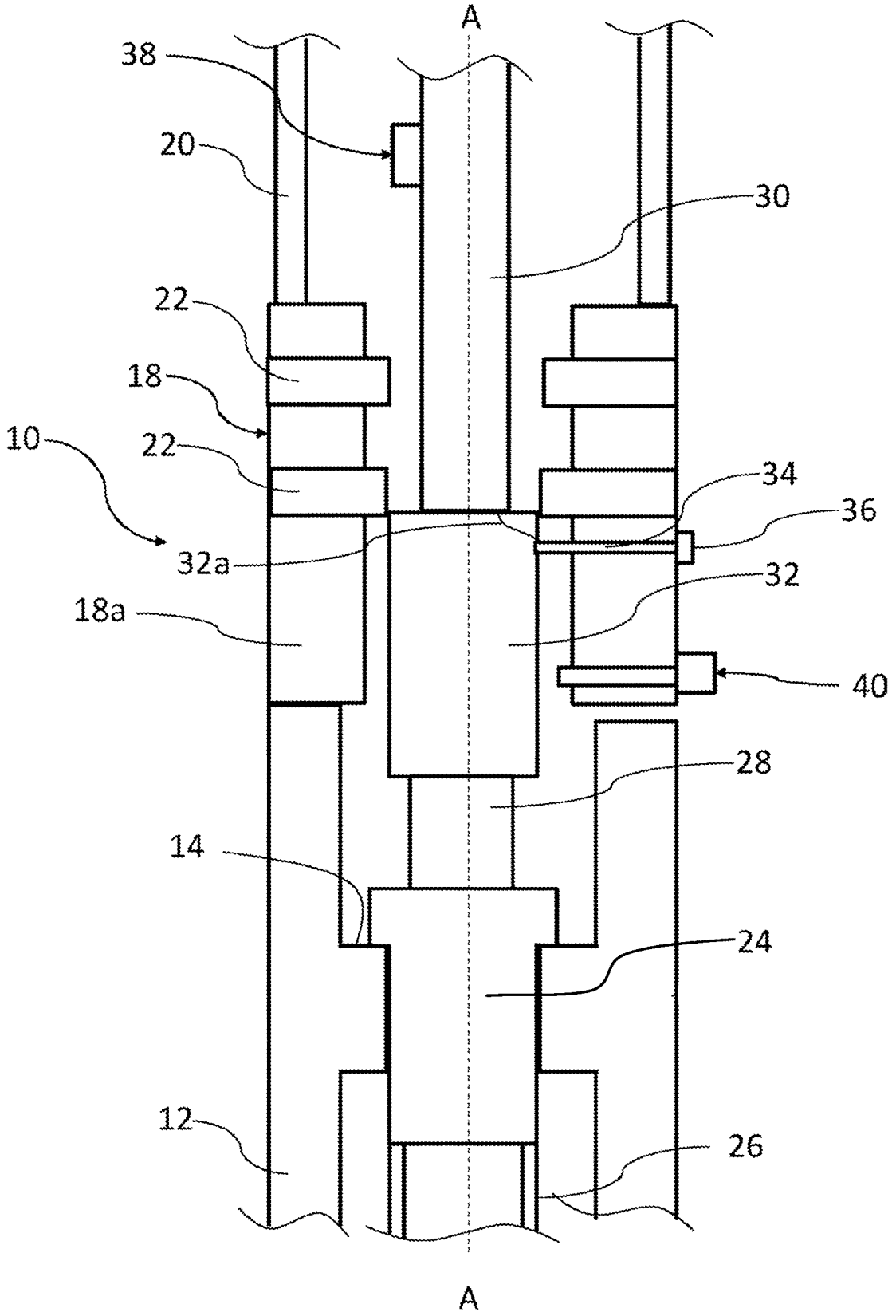
FIG. 2 is a schematic illustration of the wellhead system illustrated in FIG. 1 with the tubing hanger landed in a tubing spool.

FIG. 1 illustrates the wellhead system 10 with the tubing hanger 24 in the process of being installed, the tubing hanger 24 being lowered towards the landing shoulder 14, while FIG. 2 illustrates the wellhead system 10 with the tubing hanger 24 landed on the landing shoulder 14. This is a standard procedure which is well known to those of skill in the art.

Such configurations of wellhead systems are well known to those of skill in the art, as are similar configurations which achieve the same result. A separate tubing spool may, for example, be provided and mounted on the wellhead housing 12, and the tubing hanger 24 landed on a landing formation in the tubing spool.

The wellhead system 10 is also provided with a mechanical orientation part 32 which comprises a tubular sleeve which can enclose part of the landing string 30 or tubing hanger running tool 28 (being either integral with or secured to the landing string 30 or tubing hanger running tool 28) or which can be provided in the landing string assembly as a separate cylindrical or tubular orientation joint, which may be located between the tubing hanger running tool 28 and the landing string 30, as in the example illustrated in the drawings.

The orientation part 32 is provided with an orientation feature which engages with a corresponding orientation engagement part which is secured relative to the wellhead housing 12, by being mounted on the BOP stack 18, or on a separate orientation spool. The orientation feature and orientation engagement part are configured to interact as the tubing hanger 24 is lowered towards the landing shoulder 14, to rotate the tubing hanger running tool 28 and tubing hanger 24 about their longitudinal axis A as they are lowered, so that the tubing hanger 24 is in a desired orientation relative to the wellhead housing 12 when it lands on the landing shoulder 14.

In this example, the orientation feature comprises a generally helical ridge 32*a* which extends around the outer surface of the orientation part 32, while the orientation engagement part is a retractable pin 34 which extends through an aperture in the BOP housing 18*a*. An actuator 36 is provided which is operable to move the pin 34 between an extended position in which an end of the pin 34 extends into the main passage enclosed by the BOP housing 18*a* and a retracted position in which the end of the pin 34 is retracted out of the main passage into the aperture through the BOP housing 18*a*. A controller (not shown) is provided to operate the actuator 36 to extend or retract the pin 34 as appropriate.

It should be appreciated that the present invention is not restricted to this particular configuration of mechanical orientation system, and that any other known configuration of orientation system which is currently used for this purpose could be employed. The wellhead system according to present the invention could, for example, use a mechanical orientation system of the type described in the prior art documents referred to in the introduction above.

Such mechanical orientation system may not, however, orient the tubing hanger with sufficient precision (as was mentioned above, any deviation in the orientation of the tubing hanger of more than 1° could cause problems), and this problem can be exacerbated by wear and tear on the orientation system. Even small amounts of erosion of or damage to the pin 34 or ridge 32*a* could result in greater than 1° misorientation of the tubing hanger 24.

The wellhead system according to the present invention therefore further comprises a sensor system for alerting an operator to any significant misalignment of the tubing hanger 24.

In this example, the sensor system comprises a first sensor assembly 38 for determining the rotational orientation of the tubing hanger 24 about the longitudinal axis A relative to the wellhead housing 12. The first sensor assembly 38 is connected to a topside processor and display (not shown) by any conventional communication method, for example, wired (electrical or optical) or wireless.

If practical, the first sensor assembly 38 could be mounted on the orientation joint 32, however, the relatively small clearance between the circumference of the orientation joint 32 and the BOP housing 18*a* might render this impractical, in particular if the first sensor assembly 38 were to be retrofitted onto an existing orientation joint 32. In this embodiment, the first sensor assembly 38 is therefore mounted on the landing string 30 as close to the orientation joint 32 as possible while remaining above the BOP rams 22 when the tubing hanger 24 is landed on the landing shoulder 14*a*. Positioning the first sensor assembly 38 as close to the orientation joint 32 as possible provides that any discrepancy between the orientation of the first sensor assembly 38 and the orientation of the tubing hanger 24 due to twist and flex of the landing string 30 is minimal.

The first sensor assembly 38 comprises a gyro sensor (otherwise known as an angular rate or angular velocity sensor) which is set with its sensing axis parallel to the longitudinal axis A, and calibrated onto a known or desired heading topside. The gyro sensor may, for example, be a fiber-optic-ring sensor. Signals from the gyro sensor representing the angular velocity of the orientation joint 32 are processed by the processor to provide a live heading/orientation for the orientation joint 32 as it travels towards the wellhead housing 12.

To substantially eliminate or at least reduce errors introduced by drift of the gyro sensor, the first sensor assembly 38 may comprise a plurality of gyro sensors, all set with their sensing axis on a single axis.

The processor may be configured to use the signals from the first sensor assembly 38 to monitor the orientation of the lower end of the landing string assembly as it progresses down the riser 20 and into the wellhead assembly, and to issue an alert if the orientation of the lower end of the landing string assembly deviates from a known desired orientation when the tubing hanger 24 lands on the landing shoulder 14*a* by more than a pre-determined amount. The permitted deviation may be set to + or −1°.

In this embodiment of the present invention, the wellhead system 10 further comprises a second sensor assembly 40 for determining the elevation of the tubing hanger 24 relative to the wellhead housing 12. The second sensor assembly 37 is also connected to the topside processor and display (not shown) by any conventional communication method, for example, wired (electrical or optical) or wireless.

The second sensor assembly 40 comprises a proximity sensor such as a Hall effect sensor.

The second sensor assembly 40 could be mounted anywhere on the wellhead assembly, such as on the wellhead housing 12, BOP housing 18*a*, or, where provided, on the tubing spool or on the riser 20. It is, however, advantageously positioned above the landing shoulder 14 in order to detect when the tubing hanger 24 is approaching the landing shoulder 14. In the embodiment illustrated in the drawings, the second sensor assembly 40 is mounted on the BOP housing 18*a*, below the BOP rams 22, and detects changes in the outer diameter of the parts being lowered towards the wellhead housing 12. The signals from the second sensor assembly 40 can therefore be used to detect when one or more of the tubing hanger 24, tubing hanger running tool 28, and orientation joint 32 passes a known point on the BOP housing 18*a*. Since the elevation of the known point on the BOP housing 18*a* relative to the wellhead is known, the second sensor assembly 40 reading provides an indication of the elevation of the tubing hanger 24 relative to the wellhead housing 12 at that point in time. It will be appreciated that such a proximity sensor does not therefore provide a direct or absolute measurement of the elevation of the tubing hanger 24, but can be used in this way to determine when the tubing hanger 24 is at a predetermined elevation relative to the wellhead housing 12.

To improve the accuracy of the interpretation of the signals from the second sensor assembly 40, grooves or ridges of sufficient depth to be detected by the second sensor assembly 40 could be provided in the outer diameter of one or more of the tubing hanger 24, tubing hanger running tool 28, or orientation joint 32. The width and/or depth of each groove/ridge might be unique to the part on which it is provided to thereby provide a unique signature when that particular part passes the second sensor assembly 40, with this information then being used to mark the time where the landing string assembly is at that known elevation.

It will be appreciated, however, that the second sensor assembly 40 could equally be mounted on one of the parts at the lower end of the landing string assembly, such as the tubing hanger 24, tubing hanger running tool 28, or orientation joint 32, and be configured to detect changes in the inner diameter of the wellhead assembly. The second sensor assembly 40 can in this case detect when the tubing hanger 24 leaves the riser 20 to pass into the BOP stack 18, when it passes each BOP ram 22, when it leaves the BOP housing 18*a* to enter the wellhead housing 12, or tubing spool (where provided).

To improve the accuracy of the interpretation of the signals from the second sensor assembly 40, grooves or ridges of sufficient depth to be detected by the second sensor assembly 40 could again be provided in the inner diameter of one or more of the BOP housing 18*a*, or tubing spool. The width and or depth of each groove/ridge might be unique to the part on which it is provided to provide a unique signature when that particular part passes the second sensor assembly 40, and this information can then be used to mark the time at which the landing string assembly is at a known elevation relative to the wellhead housing 12.

The wellhead system 10 may further comprise a third sensor assembly (not shown) which comprises at least one accelerometer, and which is mounted somewhere at the lowermost end of the landing string assembly. The third sensor assembly could, for example, be mounted on the landing string 30 at the same or a similar location to the first sensor assembly 38. The third sensor assembly would also be connected to the topside processor and display (not shown) by any conventional communication method, for example, wired (electrical or optical) or wireless.

It is possible that the relatively tight tolerances between parts of the landing string assembly and the wellhead assembly might cause the landing string assembly to become stuck in the well head assembly before the tubing hanger 24 has reached the landing shoulder 14, and an operator might be mistaken into believing that the tubing hanger 24 is properly landed, when it has not.

The processor could be configured to use the signal from the second sensor assembly 40 to determine when the tubing hanger 24 has passed a predetermined point in the BOP stack 18 or tubing spool, and thus to determine the elevation of the landing string relative to the wellhead housing 12 at that point in time tO, and then to use the acceleration signals from third sensor assembly to calculate the precise elevation of the tubing hanger 24 as it is lowered past that predetermined point to make its final approach to the landing shoulder 14. This could be achieved by integrating the acceleration of the landing string as measured by the third sensor assembly over time from time tO to obtain a relatively precise elevation measurement for the landing string assembly as the tubing hanger 24 approaches the landing shoulder 14.

The elevation of the landing string assembly when the tubing hanger 24 is landed on the landing shoulder 14 is known, and this elevation determination can therefore be used to determine if the tubing hanger 24 is correctly landed, or if the landing string assembly is merely stuck in the well head assembly with the tubing hanger 24 above the landing shoulder 14.

The deceleration of the landing string assembly will moreover be high when caused by the hard landing of the tubing hanger 24 on the landing shoulder 14, whereas deceleration of the landing string will be lower when caused by the landing string sticking in the well head assembly. The deceleration profile measured by the third sensor assembly may therefore also be used to double check that the tubing hanger 24 is properly landed.

It will of course be appreciated that in an alternative embodiment of the present invention, there may be no third sensor assembly, and if the second sensor assembly comprises the accelerometer instead of a proximity sensor, the deceleration profile of the landing string assembly as determined by the second sensor assembly may be used as the sole determiner as to whether the tubing hanger 24 is properly landed.

The present invention is not limited by the embodiments described above; reference should be had to the appended claims.

LIST OF REFERENCE CHARACTERS

10 Wellhead system
12 Wellhead housing
14 Landing shoulder
18 Blowout preventer (BOP) stack
18*a* BOP housing
20 Riser
22 BOP ram
24 Tubing hanger
26 Production tubing
28 Tubing hanger running tool
30 Landing string
32 Orientation part/Orientation joint
32*a* Ridge
34 Pin
36 Actuator
38 First sensor assembly
40 Second sensor assembly
A Longitudinal axis

What is claimed is:

1. A wellhead system comprising:

a wellhead assembly which is generally tubular, the wellhead assembly being configured to be secured to a top of a borehole, the wellhead assembly comprising an orientation engagement part;

a landing string assembly which is configured to be lowered into the wellhead assembly so as to land in the wellhead assembly, the landing string assembly comprising a longitudinal axis, and an orientation part which comprises an orientation feature, wherein, the orientation engagement part of the wellhead assembly corresponds to the orientation feature, and the orientation engagement part of the wellhead assembly is configured so that, as the landing string assembly is lowered into the wellhead assembly, the orientation feature engages with the orientation engagement part to rotate the landing string assembly about the longitudinal axis into a desired orientation relative to the wellhead assembly;

an orientation sensor assembly which is mounted on the landing string assembly, the orientation sensor assembly being configured to measure an angular rotation of the landing string assembly about the longitudinal axis; and an accelerometer which is mounted on a lower end of the landing string assembly, the accelerometer being configured to measure an acceleration of the landing string assembly.

2. The wellhead system as recited in claim 1, wherein the orientation sensor assembly comprises at least one gyro sensor.

3. The wellhead system as recited in claim 1, further comprising:

a processor which is connected to the orientation sensor assembly, wherein, the orientation sensor assembly is further configured to emit signals which are indicative of the angular rotation of the landing string assembly, and the processor is configured to receive the signals from the orientation sensor assembly.

4. The wellhead system as recited in as recited in claim 3, wherein the wellhead assembly further comprises a landing formation which is configured to have the landing string assembly be landed thereon.

5. The wellhead system as recited in claim 4, wherein the processor is further configured to use the signals emitted from the orientation sensor assembly to determine an orientation of the landing string assembly relative to the wellhead assembly when the landing string assembly is landed on the landing formation.

6. The wellhead system as recited in claim 5 wherein the processor is further configured to issue an alert if the orientation of the landing string assembly relative to the wellhead assembly when the landing string assembly is landed on the landing formation deviates from a predetermined orientation by more than a predetermined amount.

7. The wellhead system as recited in claim 4, wherein the landing string assembly further comprises a landing string and a tubing hanger which is mounted on an end of the landing string.

8. The wellhead system as recited in claim 7, wherein the orientation sensor assembly is mounted on the landing string assembly adjacent to the end of the landing string.

9. The wellhead system as recited in claim 7, wherein the tubing hanger is configured to engage with the landing formation when the landing string assembly is landed in the wellhead assembly.

10. The wellhead system as recited in claim 7, wherein the landing string assembly further comprises a tubing hanger running tool via which the tubing hanger is mounted on the end of the landing string.

11. The wellhead system as recited in claim 10, wherein the orientation sensor assembly is mounted on the landing string adjacent to the tubing hanger running tool.

12. The wellhead system as recited in claim 11, wherein the orientation part further comprises an orientation joint which is mounted between the end of the landing string and the tubing hanger running tool.

13. The wellhead system as recited in claim 4, further comprising:

a processor, wherein, the accelerometer is connected to the processor so that the processor receives signals therefrom which is indicative of an acceleration of the landing string assembly, and the processor is programmed to use the signals to provide a confirmation to an operator that the landing string assembly has landed on the landing formation.

14. A wellhead system comprising:

a wellhead assembly which is generally tubular, the wellhead assembly being configured to be secured to a top of a borehole, the wellhead assembly comprising an orientation engagement part;

a landing string assembly which is configured to be lowered into the wellhead assembly so as to land in the wellhead assembly, the landing string assembly comprising a longitudinal axis, and an orientation part which comprises an orientation feature, wherein, the orientation engagement part of the wellhead assembly corresponds to the orientation feature, and the orientation engagement part of the wellhead assembly is configured so that, as the landing string assembly is lowered into the wellhead assembly, the orientation feature engages with the orientation engagement part to rotate the landing string assembly about the longitudinal axis into a desired orientation relative to the wellhead assembly;

a first sensor assembly comprising an orientation sensor assembly which is mounted on the landing string assembly, the orientation sensor assembly being configured to measure an angular rotation of the landing string assembly about the longitudinal axis;

a second sensor assembly which is configured to measure an elevation of the landing string assembly relative to the wellhead assembly; and a third sensor assembly which is mounted on a lower end of the landing string assembly, the third sensor assembly comprising an accelerometer.

15. The wellhead system as recited in claim 14, wherein the second sensor assembly comprises a proximity sensor.

16. The wellhead system as recited in claim 15, wherein, the proximity sensor as the second sensor assembly is mounted on a lower end of the landing string assembly or on the wellhead assembly, and the proximity sensor is further configured to measure a proximity of the proximity sensor to an interior surface of the wellhead assembly.

17. The wellhead system as recited in claim 16, wherein the interior surface of the wellhead assembly comprises a ridge or a groove which is configured to have a depth which is sufficient to be detected by the proximity sensor as a change in the proximity of the proximity sensor to the wellhead assembly.

18. The wellhead system as recited in claim 15, wherein the proximity sensor as the second sensor assembly is mounted on the wellhead assembly and is further configured to measure a proximity of the proximity sensor to an exterior surface of the landing string assembly.

19. The wellhead system as recited in claim 18, wherein the exterior surface of the landing string assembly comprises a ridge or a groove which is configured to have a depth which is sufficient to be detected by the proximity sensor as a change in the proximity of the proximity sensor to the wellhead assembly.

20. The wellhead system as recited in claim 14, further comprising:

a landing formation which is configured to have the landing string assembly be landed thereon; and a processor, wherein, at least one of the second sensor assembly and the third sensor assembly is connected to the processor so that the processor receives signals therefrom which are indicative of at least one of an elevation and an acceleration of the landing string assembly, and the processor is programmed to use the signals to provide a confirmation to an operator that the landing string assembly has landed on the landing formation.

* * * * *